US008061309B2

(12) United States Patent
Lenz et al.

(10) Patent No.: US 8,061,309 B2
(45) Date of Patent: Nov. 22, 2011

(54) COOLING SYSTEM

(75) Inventors: Ingo Lenz, Cologne (DE); Urban Morawitz, Cologne (DE); Richard Fritsche, Wermelskirchen (DE); Guenter Bartsch, Gummerbach (DE); Bernd Steiner, Bergisch Gladbach (DE); Jeroen Slotman, Aachen (DE)

(73) Assignee: Ford Global Technologies LLC, Dearborn, MI (US)

( * ) Notice: Subject to any disclaimer, the term of this patent is extended or adjusted under 35 U.S.C. 154(b) by 0 days.

(21) Appl. No.: 12/846,339

(22) Filed: Jul. 29, 2010

(65) Prior Publication Data

US 2011/0023797 A1 Feb. 3, 2011

(30) Foreign Application Priority Data

Jul. 30, 2009 (EP) ..... 09166864

(51) Int. Cl.
*F01P 7/14* (2006.01)
*F01P 3/00* (2006.01)
*F01P 1/06* (2006.01)

(52) U.S. Cl. ..... 123/41.29; 123/41.08; 123/41.31

(58) Field of Classification Search ..... 123/41.08–41.1, 123/41.28, 41.29, 41.31, 41.33, 41.72, 41.74, 123/41.82 R
See application file for complete search history.

(56) References Cited

U.S. PATENT DOCUMENTS

| | | | | |
|---|---|---|---|---|
| 5,735,238 | A * | 4/1998 | Russ et al. | 123/41.29 |
| 6,729,133 | B1 | 5/2004 | Sorter et al. | |
| 6,732,679 | B2 * | 5/2004 | Iizuka | 123/41.1 |
| 7,912,599 | B2 * | 3/2011 | Eiraku et al. | 123/41.02 |

FOREIGN PATENT DOCUMENTS

| | | |
|---|---|---|
| FR | 2436878 A1 | 4/1980 |
| FR | 2905423 A1 | 3/2008 |

OTHER PUBLICATIONS

European Search Report dated Mar. 31, 2010, pp. 1-6.

* cited by examiner

*Primary Examiner* — Noah Kamen
(74) *Attorney, Agent, or Firm* — Julia Voutyras; Brooks Kushman P.C.

(57) ABSTRACT

The disclosure relates to an internal combustion engine with a cooling circuit having a water jacket portion in the cylinder block and a water jacket portion in the cylinder head which has an intake portion and an exhaust portion. Flow from the intake and exhaust portions mix in an outlet housing which has a cylinder head outlet thermostat. A coolant pump provides flow to a first branch to the exhaust portion and a second branch to the water jacket portion in the cylinder block. A block thermostat is located in the second branch downstream of the coolant pump and upstream of the water jacket portion in the cylinder block. The intake portion of the water jacket portion in the cylinder head is fluidly coupled to the water jacket portion in the cylinder block.

20 Claims, 1 Drawing Sheet

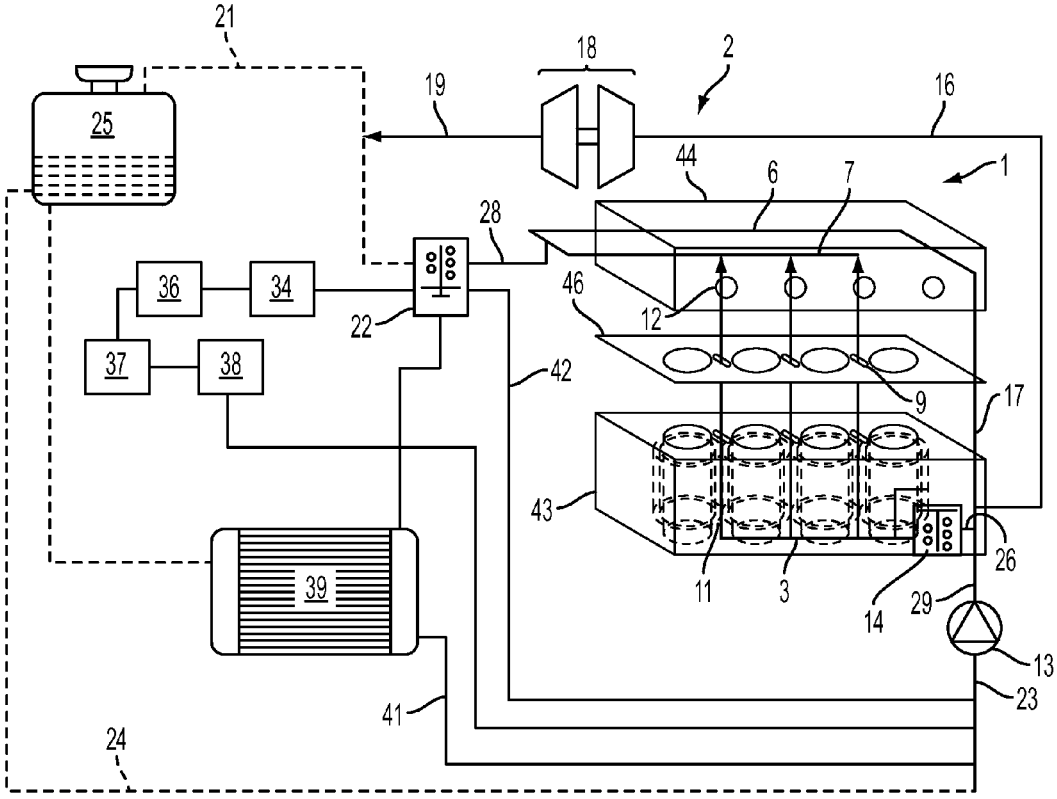
THE FIGURE

COOLING SYSTEM

CROSS-REFERENCE TO RELATED APPLICATIONS

This application claims foreign priority benefits under 35 U.S.C. §119(a)-(d) to EP 09166864.0 filed Jul. 30, 2009, which is hereby incorporated by reference in its entirety.

BACKGROUND

1. Technical Field

The invention relates to an internal combustion engine having a coolant circuit which is divided into a cylinder block-side coolant region and a cylinder head-side coolant region, the cylinder block-side coolant region having at least one block thermostat.

2. Background Art

It is known to allow a coolant of a coolant circuit to flow through the engine block and the cylinder head of the internal combustion engine separately from one another. Thus, the cylinder head, which is coupled thermally to the combustion air and the engine block, which is coupled thermally to the friction points, can be cooled differently. What is to be achieved by a "split cooling system" (separate coolant circuit), as it is known, is that the cylinder head is cooled in the warm-up phase of the internal combustion engine, while the engine block is initially not yet to be cooled, so that the engine block can be brought more quickly to a desired operating temperature.

SUMMARY

An internal combustion engine with a cooling circuit is disclosed which has a water jacket portion in the cylinder block and a water jacket portion in the cylinder head which further has an intake portion and an exhaust portion. An outlet housing is coupled to the intake and exhaust portions with a cylinder head outlet controller coupled to the outlet housing. The intake portion and coolant from the exhaust portion mix upstream of the cylinder head outlet controller. The circuit may further include a coolant pump providing flow to a first branch, a second branch, and a third branch of the cooling circuit. The first branch is coupled to the exhaust portion of the water jacket portion in the cylinder head; the second branch is coupled to the water jacket portion in the cylinder block; and the third branch is coupled to a turbocharger. A block thermostat is located in the second branch downstream of the coolant pump and upstream of the water jacket portion in the cylinder block. The intake portion of the water jacket portion in the cylinder head is fluidly coupled to the water jacket portion in the cylinder block. A cylinder head gasket is arranged to seal between the cylinder head and the cylinder block. The cylinder head gasket has multiple orifices to permit flow between the water jacket portions in the cylinder head and the cylinder block. Coolant from the intake portion and coolant are permitted to mix downstream of the cylinder head. In one embodiment, the cylinder head outlet controller is a mechanical thermostat. Alternatively, the cylinder head outlet controller is an electrically controllable thermostat.

The circuit may further include a radiator coupled to an inlet side of the coolant pump and an expansion tank fluidly coupled to the radiator. The circuit may further include at least one of: an EGR cooler, a cabin heater, and an oil heat exchanger on an upstream side of the coolant pump.

According to some embodiments, the block thermostat opens at a lower temperature than the cylinder head outlet thermostat or controller.

According to embodiments of the disclosure, the warm-up behavior of the engine is improved by providing independent cooling to various portions of the cooling circuit.

BRIEF DESCRIPTION OF THE DRAWING

The FIGURE shows an exemplary coolant circuit of an internal combustion engine.

DETAILED DESCRIPTION

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations.

The FIGURE shows an internal combustion engine 1 which has a coolant circuit 2. The coolant circuit 2 is divided into a cylinder block water jacket portion 3 and a cylinder head water jacket portion, so that a split cooling system is formed. Further, the cylinder head water jacket portion is divided, for example, into an exhaust portion 6 and an intake portion 7, with exhaust portion 6 proximate exhaust valves and intake portion 7 proximate intake valves. Such arrangement is not intended to limit the disclosure. Coolant flow can be separately controllable in portions 3, 6, and 7.

Cooling circuit 2 has a coolant pump 13 providing flow into a coolant pump outlet 29. A block thermostat 14 is integrated into cylinder block 43, per the embodiment of FIG. 1. Alternatively, block thermostat 14 is provided separately. From pump 13, coolant flows into a first branch 17 coupled to cylinder head water jacket portion 6 and 7, a second branch 26 supplying flow to block thermostat 14, and a third branch 16 coupled to a turbocharger 18. In one embodiment, block thermostat 14 contains a wax element that allows coolant flow in one direction only to prevent backflow of coolant in the direction of coolant pump 13. Such flow in the one direction is provided regardless of whether block thermostat 14 is open or closed.

Turbocharger 18, which is supplied by third branch 16, has an outlet passage 19 that flows into a connecting line 21, which then flows into an expansion tank 25. Connecting line 21 couples a cylinder head outlet thermostat 22 and the expansion tank 25. Outlet passage 19 of turbocharger 18 may alternatively be connected directly to a pump inlet 23 or to a coolant pump return 24.

Block thermostat 14 is provided to facilitate the split cooling system. Coolant passing through block thermostat 14, as provided by second branch 26, flows through the water jacket portion 3 of cylinder block 43 and flows into intake portion 7 via orifices in a head gasket 46 of water jacket portion 6 and 7 of cylinder head 44 without previously having contact with the coolant flowing in exhaust portion 6 of water jacket portion. Flow through exhaust portion 6 and intake portion 7 of the water jacket portion enter outlet housing 28.

The two coolant streams mix in outlet housing 28 upstream of thermostat 22. A return flow of coolant may then take place, for example, via a venting valve 34, an EGR cooler 36, cabin heater 37, an oil heat exchanger 38. Alternatively, coolant returns through radiator 39 back to coolant pump 13. The arrangement illustrated in The FIGURE is simply one example embodiment. Alternative arrangements are within the scope of the present disclosure.

As illustrated, thermostat 22 is also connected to radiator 39 which is connected via connecting line 41 to coolant pump inflow 23. It is also possible to connect thermostat 22 to coolant pump inflow 23 via a bypass 42. As illustrated, the oil heat exchanger 38 also issues in the coolant pump inflow 23. Radiator 39 is coupled to expansion tank 25. Thermostat 22 may be electrically controllable or may be a conventional mechanical thermostat.

As illustrated, block thermostat 14 is integrated in the cylinder block. However, block thermostat 14 may also be a separate component. In one embodiment coolant pump outlet 29 is connected directly to the cylinder block 43 or to the water jacket portion 3. According to one embodiment, outlet housing 28 is a separate component. In some embodiments, outlet housing 28 may include an EGR valve with corresponding lines to supply the EGR cooler 36.

In a warm-up phase of the internal combustion engine 1, block thermostat 14 can remain closed for longer, since the vapor or air bubbles which possibly form can be diverted out of the cylinder block 43 or its upper portion via the above-described path comprising cooling passage 11, cooling slot 9, and cooling passage 12 into water jacket portion 6 and 7. Consequently, warm-up behavior of the internal combustion engine is decisively improved, since block thermostat 14 is opened only when an exchange of the coolant in the water jacket 3 in the cylinder block 43 is beneficial.

Cooling slot 9 is not connected to water jacket portion 3 directly. Instead, it is indirectly connected via cooling passage 11. Cooling passage 11 is, in one embodiment, an elongated void defined in a face of cylinder head 44.

While the best mode has been described in detail, those familiar with the art will recognize various alternative designs and embodiments within the scope of the following claims. Where one or more embodiments have been described as providing advantages or being preferred over other embodiments and/or over background art in regard to one or more desired characteristics, one of ordinary skill in the art will recognize that compromises may be made among various features to achieve desired system attributes, which may depend on the specific application or implementation. These attributes include, but are not limited to: cost, strength, durability, life cycle cost, marketability, appearance, packaging, size, serviceability, weight, manufacturability, ease of assembly, etc. The embodiments described as being less desirable relative to other embodiments with respect to one or more characteristics are not outside the scope of the disclosure as claimed.

What is claimed is:

1. An internal combustion engine with a cooling circuit, comprising:

a water jacket portion in a cylinder block;

a water jacket portion in a cylinder head having an intake portion and an exhaust portion;

an outlet housing coupled to the intake and exhaust portions;

a cylinder head outlet controller coupled to the outlet housing wherein coolant from the intake portion and coolant from the exhaust portion mix upstream of the cylinder head outlet controller;

a coolant pump providing flow to a first branch and a second branch of the cooling circuit wherein the first branch is coupled to the exhaust portion of the water jacket portion in the cylinder head and the second branch is coupled to the water jacket portion in the cylinder block; and a block thermostat located in the second branch downstream of the coolant pump and upstream of the water jacket portion in the cylinder block wherein the intake portion of the water jacket portion in the cylinder head is fluidly coupled to the water jacket portion in the cylinder block.

2. The engine of claim 1 further comprising: a cylinder head gasket arranged to seal between the cylinder head and the cylinder block wherein the cylinder head gasket has multiple orifices to permit flow between the water jacket portions in the cylinder head and the cylinder block.

3. The engine of claim 1 wherein coolant from the intake portion and coolant from the exhaust portion are permitted to mix downstream of the cylinder head.

4. The engine of claim 1 wherein the cylinder head outlet controller is a mechanical thermostat.

5. The engine of claim 1 wherein the cylinder head outlet controller is an electrically controllable thermostat.

6. The engine of claim 1, further comprising:

a radiator coupled to an inlet side of the coolant pump; and an expansion tank fluidly coupled to the radiator.

7. The engine of claim 1 wherein the block thermostat control coolant flow through the cylinder block.

8. A cooling circuit for an internal combustion engine, comprising:

a water jacket portion in a cylinder head having an intake portion and an exhaust portion;

an outlet housing coupled to the intake and exhaust portions;

a cylinder head outlet thermostat coupled to the outlet housing wherein coolant from the intake portion and coolant from the exhaust portion mix upstream of the cylinder head outlet thermostat;

a coolant pump providing flow to a first branch and a second branch of the cooling circuit wherein the first branch is coupled to the exhaust portion of the water jacket portion in the cylinder head and the second branch is coupled to the water jacket portion in the cylinder block;

a block thermostat located in the second branch downstream of the coolant pump and upstream of the water jacket portion in the cylinder block; and a cylinder head gasket arranged between the cylinder head and the cylinder block, wherein the cylinder head gasket has orifices to allow the intake portion of the water jacket portion in the cylinder head to be fluidly coupled to the water jacket portion in the cylinder block at multiple locations.

9. The cooling circuit of claim 8 wherein coolant from the intake portion and coolant from the exhaust portion are prevented from mixing within the water jacket portion in the cylinder head.

10. The cooling circuit of claim 8 wherein the block thermostat is one of: integrated into the cylinder block and separate from the cylinder block.

11. The cooling circuit of claim 8 wherein the coolant pump further provides flow to a third branch coupled to a turbocharger.

12. The cooling circuit of claim 8 wherein the block thermostat opens at a lower temperature than the cylinder head outlet thermostat.

13. The cooling circuit of claim 8, further comprising:

a radiator coupled to an inlet side of the coolant pump; and an expansion tank fluidly coupled to the radiator.

14. The engine of claim 8, further comprising at an EGR cooler on an upstream side of the coolant pump.

15. The engine of claim 8, further comprising a cabin heater on an upstream side of the coolant pump.

16. The engine of claim 8, further comprising an oil heat exchanger on an upstream side of the coolant pump.

17. The engine of claim 8, further comprising a venting valve on an upstream side of the coolant pump.

18. A cooling circuit comprising:

a coolant pump providing flow to a first and a second branch wherein the first branch is coupled to an exhaust portion of a water jacket portion in a cylinder head and the second branch is coupled to a water jacket portion of a cylinder block; and a block thermostat located in the second branch downstream of the coolant pump and upstream of the water jacket portion in the cylinder block.

19. The cooling circuit of claim 18 wherein the coolant pump further provides flow to a third branch coupled to a turbocharger.

20. The cooling circuit of claim 18 wherein the block thermostat is one of: integrated into the cylinder block and separate from the cylinder block.

* * * * *